United States Patent [19]

Ricca

[11] Patent Number: 4,882,969

[45] Date of Patent: Nov. 28, 1989

[54] PAGE TURNING DEVICE

[76] Inventor: Tom L. Ricca, 1413 Wyandotte Rd., Columbus, Ohio 43212

[21] Appl. No.: 242,628

[22] Filed: Sep. 12, 1988

[51] Int. Cl.[4] ..... G10G 7/00

[52] U.S. Cl. ..... 84/487

[58] Field of Search ..... 84/486, 487, 490, 491, 84/496, 497, 498, 507, 511, 513, 515

[56] References Cited

U.S. PATENT DOCUMENTS 3,064,518 11/1962 Chernishenko ..... 84/487

FOREIGN PATENT DOCUMENTS 2473 6/1932 Australia ..... 84/487
82264 11/1894 Fed. Rep. of Germany ..... 84/486
8902 of 1897 United Kingdom ..... 84/486

*Primary Examiner*—L. T. Hix
*Assistant Examiner*—Brian W. Brown

[57] ABSTRACT

A page turning device for a book whereby, after a book has been fixed by a securing means and a plurality of rods rotatably hanging at their top ends around a fixed hanger and positioned in sequence each behind one leaf of said book have been pushed by a pushing means toward the very first present active rod defined as the rod which has been made to be confined by the firm and spatially precise stopping of a first limiting stop means, and the first set of pages has been exposed for reading, the cue for a forward page turning would start the control means to activate a selecting means to choose said present active rod, then to activate a driving means to act on said selecting means to cause the lower tip of said present active rod to overcome momentarily said firm and spatially precise stopping by said first limiting stop means and to travel along a guiding means past the spine of said book, to push along and to turn a leaf of said book and at the end of its course, to lock open the next set of pages of said book for reading by virtue of the firm stopping by a second limiting stop means, then to activate a returning means to relocate said selecting means to a spatially precise stand-by location near said first limiting stop means, while said pushing means and an updating means make the rod next to the rod that was moved into a new present active rod, thus making the invention ready, repetitively, for the next cue for page turning again, until all the turnings are exhausted. Backward page turning and hold-down are also considered.

20 Claims, 7 Drawing Sheets

PAGE TURNING DEVICE

BACKGROUND OF THE INVENTION

This invention relates to a novel and improved page turning device utilizable in connection with the turning of pages of music for professional and amateur musicians and of reading material for severely handicapped people or hospitalized people who cannot temporarily use their hands.

It is well appreciated that in performing their art, most musicians are busy with both hands and have problems turning pages of music at the right time. Up until now, the solutions are makeshift solutions at best: in the case of a pianist, another person who can follow the written music or some sort of cue has to sit next to him to turn the page at the right time; in the case of an orchestra, practically half of a section of musicians has to stop playing in order to turn the page for the other half, before being able to resume playing along; in the case of amateur musicians playing some unfamiliar music, they have to stop playing, often at the middle of a musical phase, to turn the page before continuing. The disadvantages of these solutions are that they are either expensive, conspicuous, anaesthetic or particularly unreliable if the pages were not prepared beforehand, for instance with tabs, for sure turnings.

Numerous inventions have been proposed as better solutions to those problems, but up until now, none is considered good enough in terms of versatility, inconspicuousness, and especially, reliability.

Also, as an aid to handicapped people, a page turning device should require only a minimal human action to trigger and make it go by itself through a whole cycle of page turning automatically.

It is therefore the goal of the present invention to provide an improved solution to all the problems aforementioned.

SUMMARY OF THE INVENTION

General Principles of the Invention

The principles of the present invention would be easier to understand in details later on if it is considered as a page turning device for a book, comprising:

a. a securing means to adjustably fix a book into an operative position which would allow material to be suitably exposed for reading;

b. a plurality of turning rods (referred hereafter as rods) rotatably swinging at their top ends around an adjustably fixed hanger;

c. each of said rods being programmably positioned in sequence behind one leaf of said book;

d. guiding means for the lower ends of said rods to travel in a predetermined path;

e. said guiding means allowing the lower end of each of said rods to travel freely between the two extremes of said predetermined path, maintaining said rods in their sequence when they are to travel in groups or when they are lined up to wait for operations;

f. a first limiting stop means located near one of said extremes of said path to provide a firm and spatially precise stopping to the lower end of one of said rods that is made ready to act in the operation of the invention, hereby defined as a present active rod;

g. a second limiting stop means adjustably located near the second of said extremes of said path to provide a firm and spatially precise stopping to the last one of said rods which was made to travel from said first limiting stop means toward said second limiting stop means within the allowance of said guiding means, hereby defined as a last active rod;

h. pushing means to push the group of said rods which crowd near said first limiting stop toward the rod that is firmly and precisely stopped by said first limiting stop, and to push the group of rods which crowd near said second limiting stop toward the rod that is stopped by said second limiting stop means;

i. selecting means to choose a present active rod, and to isolate said present active rod from the rods that are pushed toward it;

j. driving means to act on said selecting means to cause said present active rod to overcome momentarily said firm and spatially precise stopping by said first limiting stop means and to travel along said guiding means, in the direction from the first stopping means area to the second stopping means area, defined as the forward direction, pushing along with it one leaf behind which said present active rod is positioned, and thus causing, by proper design of said predetermined path, the turning of said one leaf and exposing the next set of pages for reading;

k. updating means to cause the rod that was positioned next to said present active rod before the operation, hereby defined as a next active rod to take the position of a new present active rod by causing said first limiting stop means to provide again, after being overcome by said present active rod, immediately said firm and precise stopping to the lower end of said next active rod;

l. said driving means causing said present active rod to overcome said firm stopping by said second limiting stop means and to make said present active rod into a last active rod, within the allowance of said guiding means;

m. returning means to relocate said selecting means to a spatially precise stand-by position near said first limiting stop means;

n. control means to activate on cue the actuation of said selecting means, driving means and returning means;

o. whereby, after a book has been adjustably fixed by said securing means and said plurality of rods has been programmably positioned in sequence each behind one leaf of said book and said plurality of rods has been pushed toward the very first present active rod which has been made to be confined by said firm and spatially precise stopping of said first limiting stop means, and the sequentially first set of pages has been exposed for reading, the cue for a forward page turning would start said control means to activate said selecting means to choose said present active rod, then to activate said driving means to act on said selecting means to cause said present active rod to overcome momentarily said firm and spatially precise stopping by said first limiting stop means and to travel along said guiding means, turning a leaf of said book and at the end of the course of said present active rod, locking open the next set of pages of said book for reading by virtue of said firm stopping by said second limiting stop means, then to activate said returning means to relocate said selecting means to said spatially precise stand-by location while said pushing means and updating means complete the making of said next active rod into a new present active rod, thus making the invention ready, in a repetitive manner, for the next cue for page turning again, until all the turnings are exhausted.

These basic principles of operation of the invention may be extended, at low cost, to include the backward page turning operation needed in general in music sheet turnings. The principles of backward page turning of the present invention can be understood if the invention is considered to be a page turning device for a book as described above in which said control means includes means to activate on cue the activation of said driving means to cause the selecting block of said selecting means to travel along said tracking path in the forward direction, wherein, at a precise spatially fixed position with respect to said second limiting stop means, said control means is to actuate said powering means to move said needle's pointed end from said inoperative position to said operative position to cause said needle to overcome the action of said pushing means in separating two particular rods composed of the rod which is said last active rod and the rod next to it,—now defined as the past active rod—, from all the other rods crowding nearby, then to actuate said returning means to relocate said selecting block to said spatially precise stand-by position near said first limiting stop means, causing, in the process, the pushing of said two particular rods in the direction from said second limiting stop means toward said first limiting stop means, defined as the backward direction, overcoming the stopping of said second limiting stop means and then locking said two particular rods by virtue of said first limiting stop means at the end of the course of said selecting block; whereby, after said book has been adjustably fixed by said securing means, a first rod has been programmed to be locked by the stopping of said second limiting stop means, said plurality of rods has been programmably positioned in sequence each behind one leaf of said book, said plurality of rods has been pushed toward said very first present active rod which has been made to be confined by said firm and spatially precise stopping of said first limiting stop means, exposing in the process the sequentially very first set of pages of said book for reading, and after at least one forward page turning has been performed on the invention, the cue for a backward page turning would start said control means to activate said driving means to act on said selecting block to travel along said tracking path in said forward direction; and, at a precise spatially fixed position with respect to said second limiting stop means, to activate said powering means to move said needle's pointed end from said inoperative to said operative position to cause the pointed end and the body of said needle to overcome the action of said pushing means in separating said two particular rods from all other rods crowding nearby; and to actuate said returning means to relocate said selecting block to said spatially precise stand-by position near said first limiting stop means, causing in the process the pushing of said two particular rods in said backward direction along said predetermined path, thus causing the one leaf confined between said two particular rods to turn in a way as to expose the last set of pages for reading, and to lock said two rods by virtue of said first limiting stop means; to actuate said resetting means to return said needle's pointed end from said operational position back to said inoperative position while said pushing means and updating means complete the making of said past active rod—now in the area near said first limiting stop means—into a temporary present active rod; then finally to issue automatically a cue for a complete forward page turning to bring said temporary present active rod to the area near said second limiting stop means and to lock it there by virtue of said second limiting means as a new last active rod; thus making the invention ready, in a repeated manner, for the next cue for backward, or forward page turning until all the turnings are exhausted.

Based on the basic principles of operation of the invention one object of the present invention is to provide a page turning device that can retrofit the majority of music stands in use today for automatically turning the pages of music with a single non-critical tap of a foot or another convenient body part on an easily accessible electric switch assembly.

Another object of the invention is to provide a page turning device that can turn pages of books of different sizes or an assortment of loose sheets of different sizes inserted in suitable transparent flat pockets bound together beforehand as flippable pages of a book.

Still another object of the invention is to provide a page turning device that can turn pages which are not necessarily consecutive, in forward and also backward directions.

Finally, another object of the invention is to provide a page turning device which is portable in a brief case, can turn several pages—over 50 very easily—after one quick set up, is inexpensively and easily manufacturable, is of high reliability during operation and instills security of mind by providing instant manual back-up mode if anything should go wrong in the automatic mode of operation.

Other objects and advantages of the invention will become apparent from the following detailed description when taken in conjunction with the accompanying drawings.

DETAILED DESCRIPTION OF THE PREFERRED EMBODIMENT

To facilitate the understanding of the structure and operation of the preferred embodiment of the invention, several sets of description/operation sections would be adopted.

Description/Operation of Securing Means

Figure 2:
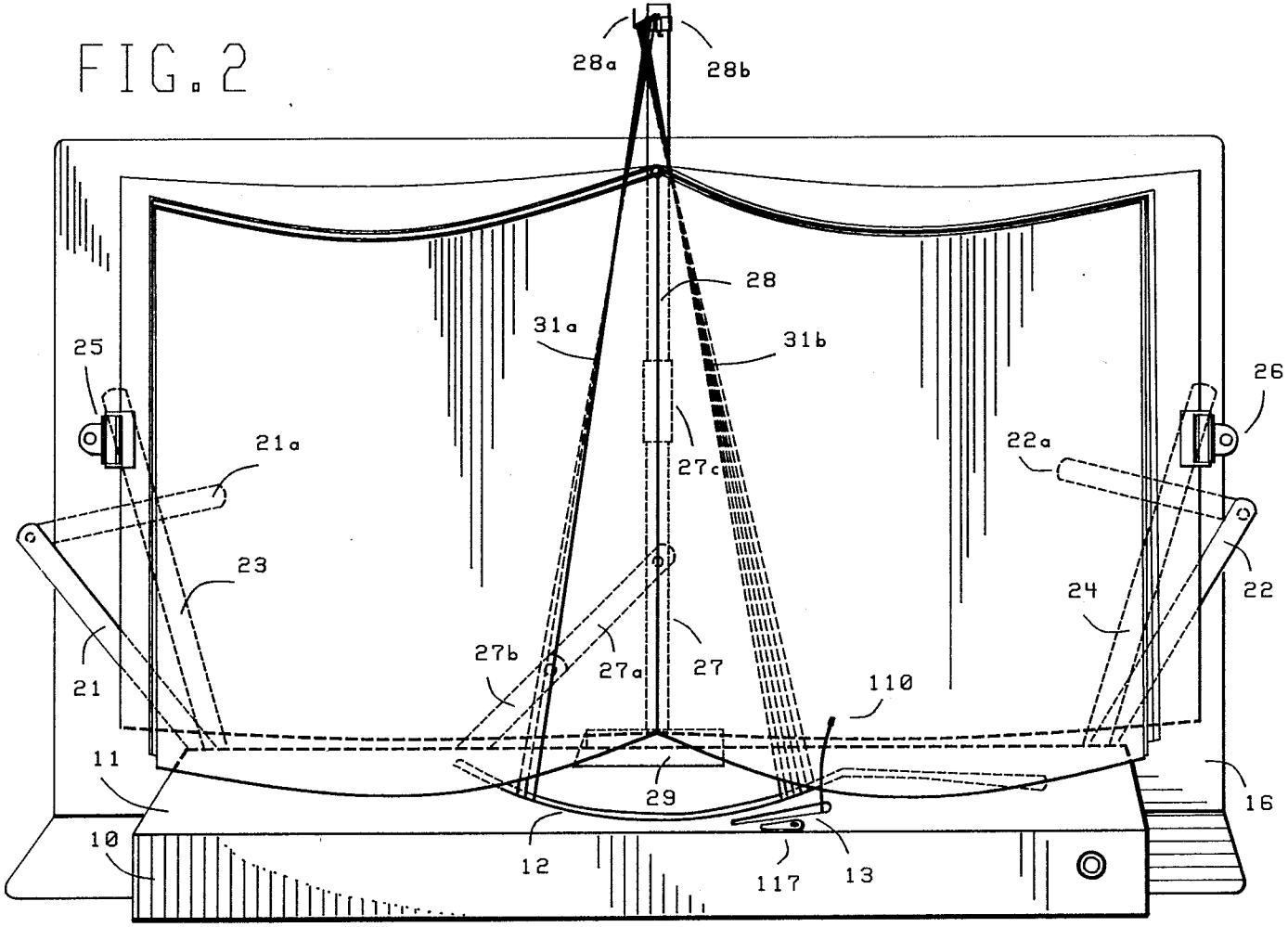
FIG. 2 is sectional and fragmented perspective view of a preferred embodiment of the invention attached to the desk of a music stand commonly found in orchestras.

Referring to FIG. 2, the operative elements of the page turning device of the invention are assembled in a housing 10 preferably made of molded plastic material, although wood, metal, or other suitable material may be used. Housing 10 is molded of relatively thin plastic material, preferably of the stiff kind such as bakelite, and have an essentially rectangular shape. Its bottom, front, back and end walls enclose a hollow interior for housing certain of the operative elements. Its removable top 11 is flat and molded with well defined apertures 12 and 13 through which the operative elements contained inside the housing can cooperate with operative elements external to said housing.

Figure 3A:
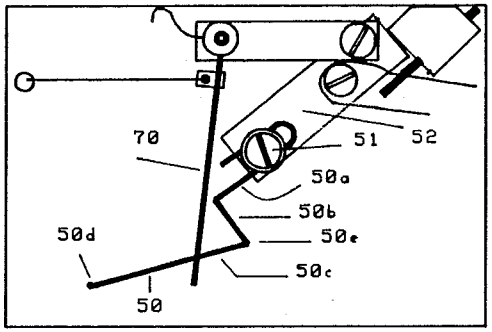
FIG. 3*a* shows more details of the first limiting stop means.
Figure 3:
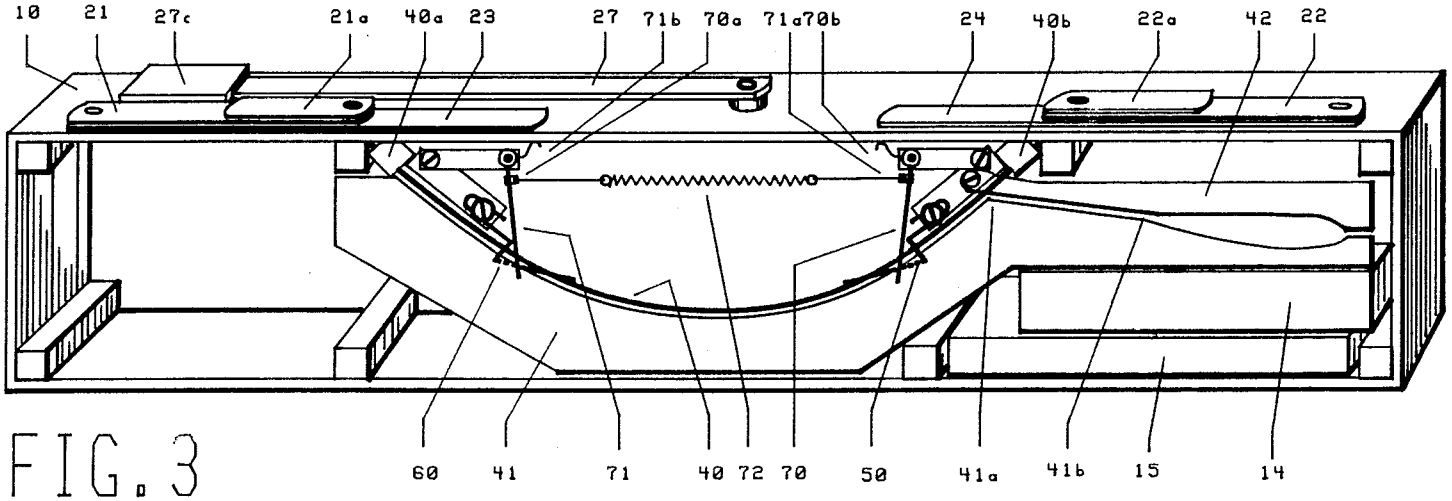
FIG. 3 is a perspective top view of the invention mechanism disposed in a housing provided on a music desk, with the top cover of the housing removed and with the accessories already folded for portability.

Visible in FIGS. 2 and 3, the arms 21 and 22 can swing around the points where they are attached onto the back of housing 10 at one of their ends. Their free ends, in turn, are attached to pieces 21*a* and 22*a* which can swing their own free ends around the points of attachment with arms 21 and 22. Arms 21 and 22 and their respective associated pieces 21*a* and 22*a* form the preferred means to attach securely the housing of the invention onto practically every music stand desk that has, for support of a music book a relatively thin flat plate or a foldable frame of flat wires. The swinging arrangement of 21, 21*a* , 22, and 22*a* allows a user of the invention to swing arms 21 and 22 and then 21*a* and 22*a* so that 21 and 22 rest on the front and 21*a* and 22*a* rest snugly on the back of the flat plate 16 or two chosen flat wires on the frame of such a music desk.

For a music desk made of thick material, such as found on most keyboard instruments, a low-cost, foldable flat-wire desk specially made for the invention can be secured similarly to said housing and then the whole thing can rest securely against such thick-material desk.

Preferably, on the same swinging axes of arms 21 and 22 are attached the two swinging posts 23 and 24 of suitable length. Cooperating with the two paper clip 25 and 26, posts 23 and 24 are parts of the preferred means to secure the cover of a book and consequently that book itself, onto the desk of the music stand.

At the middle of the back of housing 10 is attached a swinging flat-wire column 27 erectable securely in an up-pointing direction by a foldable mechanical linkage composed of parts 27*a* and 27*b*. The free end of column 27 is terminated preferably by a flat tubing 27*c* serving as a secure receiver to a mating removable top-column 28 made preferably of steel flat wire as well as column 27.

An L-profile sheet metal support 29 can be arranged easily to lay flat down on top of cover 11 for portability and to move and lock itself into a suitable distance about half-inch above said top when in the operative position. During set up time, when the user of the invention rests the lower end of the part of the book where all the sheets or leaves are joined together called spine of the book on top of support 29 in its operative position and exercise the use of 23, 24, 25, and 26 on the cover of said book so that both sides of the cover are of about the same height in relation to the top 11 of the housing 10, it can be seen that the leaves of said book can be turned freely without their lower end getting snagged on the surface of top 11. It is easy to conceive further securing of the top of spine of the book onto the top-column 28 with an additional paper clip similar to clip 25. With enough friction built into axes of swinging of posts 23 and 24, it is conceivable that elements 23, 24, 25, 26, 27, 28 and 29 form an adequate securing means to adjustably fix a book of a practical range of sizes into an operative position which would allow material to be suitably exposed for reading.

Top-column 28 serves further in another function. Opposite to the end inserted into receiver 27*c* in the operative position is its top end where it is fitted with a hanger 28*a* thanks to simple securing means 28*b*. The distance from hanger 28*a* to the top 11 of housing 10 is fixed so that hanger 28*a* would be above the tallest music book found practically in the art, but preferably not so high above the music desk as to be anaesthetic.

Description/Operation of Turning Rods

Referring again to FIG. 2, it can be seen that a plurality of rods 31*a* and 31*b* hang on hanger 28*a*, thereabout they can swing freely through part of a solid angle in space. These rods are preferably made with a straight spring-steel wire of about 0.031 in. to 0.039 in., terminated at the upper end by a close loop of the same material and of suitable diameter. They are the main active elements that do the turning of the pages in the invention. They can do so if each one of them is programmed to be positioned behind a sheet or leaf of the book secured as abovementioned and then have some means to select the rod coming up in the sequence to be moved and to move it across the surface encompassing the spine of said book and said rod would push the leaf along and make it turn around the spine of said book. To do that systematically, the present invention proposes a group of means cooperating with each others toward the goal of allowing a user of the invention to trigger a whole page turning operation with a minimal action.

Description/Operation of Guiding Means

A preferred guiding means for the lower ends of the rods to travel in a predetermined path is depicted in FIG. 3. Numeral 40 designates a tensioning bar preferably of spring steel of about 0.055" diameter and of a chosen length determined empirically or mathematically by the desired predetermined path. It was found empirically that the curved shape as shown in FIG. 3 for the tensioning bar 40 is desirable in that it would guide the lower ends of the rods through a most natural path for the leaf to follow when it is turned by said rod, with the extra benefit that the lower tips of the rods stay essentially the same distance from the bottom of the housing 10 during the whole operational travel of said rods, thus affording to keep a longer tip segment of a rod between its lower tip and the contact point with said tensioning bar. This situation is particularly valuable when a rod has to turn a great number of leaves in one turning, when such unusual heavy loads would tend to bend the rod out of the guiding means if said tip segment was too short at some points during the travel of the rod. This last situation happens in the case where said tensioning bar is made straight: it can be visualized easily that if a rod length is made to be long enough as to almost touch the bottom of housing 10 when said rod is near the center of tensioning bar 40, said length may be so short as to cause trouble with said unusual heavy loads at the areas near the extremes of said tensioning bar. Otherwise, a straight predetermined path works also as well in this invention.

If the uniformity in diameter of the tensioning bar 40 is assumed as in real practice, it can be shown mathematically that the shape of the curved tensioning bar 40 shown in FIG. 3 is consistently defined by the length of tensioning bar 40 and the chord of its arc when said tensioning bar is forcingly bent into a curve by allowing each end of said tensioning bar to push freely against a spatially fixed shallow well (not shown) of diameter just a little bit greater than the diameter of said tensioning bar, and by anchoring portions of said tensioning bar near its two ends—with the aid of plastic pieces 40*a* and 40*b*, which are anchored securely onto the bottom and the back wall of housing 10—in a plane of said arc chosen to be parallel to the bottom of housing 10, forcing said arc to take on a self-aligning shape, facilitating the manufacturing of the invention. The chord of an arc, as used above, is defined as the length of the straight segment between the two tips of the arc. The tips of tensioning bar 40 may be conveniently located on the inside of the back wall of housing 10, and said anchoring may be done easily with some additional plastic pieces 40*a* and 40*b* affixed on that wall at selected places.

The guiding means visible in FIG. 3 is composed further of a main rail 41 and a secondary rail 42, preferably made of hard plastic such as the naterial commercially known as delrin. The main rail 41 is to have a concave contour of essentially uniform thickness and parallel to the convex edge of the arc of tensioning bar 40 on most of its length up to corner 41*a*, and secured, after adjustments, on top of some bosses protruding from the bottom of housing 10 (not shown), so that said convex edge forms with said concave contour a continuous slot whose width is a chosen width to be a little bit greater than the diameter of said plurality of rods so that the tips of these rods can moves very easily along that continuous slot. The secondary rail 42, forms with the remaining part 41*b* of the main rail 41 a slot going gradually from a receiving width considerably greater than said chosen width to a width of the same size as said chosen width when it merges into said continuous slot. This way, each of said plurality of rods 31*a* and 31*b*, after hanging on one of the supporting shafts similar to hanger 28*a*, can have its lower end enter easily said continuous slot by way of said receiving width, if the length of these rods is made just right as discussed when unusual loads to the rods were mentioned. When these rods are pushed further along past the corner 41*a* into the continuous slot formed by 40 and 41, they are constrained to follows rigidly a predetermined path, one after another in sequence always when they are to travel in groups, or even when they are pushed relatively hard against each others, as when they are lined up to wait for operations of the invention.

Description/Operation of First and Second Limiting Stop Means

A first limiting stop means located near corner 41*a* provides a firm and spatially precise stopping to the lower end of one of said plurality of rods that is made ready to act in the operation of the invention, defined before as a present active rod. Referring to FIG. 3, element 50 is shown to be preferable to other numerous schemes in serving as such first limiting stop means. It is a wire form preferably made of a shape-memorizing material characterized by spring steel of 0.020" diameter havng at one end thereof, near corner 41*a*, a U-shaped open loop 50*a* adapted to be adjustably secured with screw 51 onto element 52 which may be made of flat wire steel, and which is itself secured onto the bottom of housing 10 via a molded boss in the bottom of housing 10 (not shown) with a screw. At the center of element 50 is a first straight segment 50*b* of suitable length and which is the continuation of one branch of 50*a* and which forms an approximately right angle with it. This first segment 50*b* is preferably made and fixed in place so that it will be essentially orthogonal to the tangent of the convex edge of tensioning bar 40 at the point where it crosses that convex edge in the inoperative mode of this first limiting stop means 50. This first segment 50*b* continues into another segment 50*c* forming with 50*b* an angle between 45 and 75 degrees. The free end of 50*c* continues into a third relatively short segment 50*d* of which the free end points essentially away from the bottom of housing 10, thus 50*c* forms part of a line essentially normal to the plane passing by all the lines of element 50, and bears against one point of the concave edge of tensioning bar 40 in the inoperative mode and provides an additional means for adjusting suitably the firmness and the precision of the location of element 50. See also FIG. 3*a* for details.

There is one inoperative mode in which element 50 is static and four significant operative modes in which it moves. Referring to the general principles of operation of the invention, they are described concisely as follows:

In the inoperative mode of element 50, said pushing means, endowed with suitable strength, would push said presently active rod toward said first straight segment 50*b* in the forward direction, and would cause only said present active rod to bear against said first straight segment and to be stopped firmly thereby at a spatial location precise in relation to said needle's pointed end of said selecting means, thereby would provide the limiting stopping action for said first limiting stop means.

In the first operative mode found typically in a forward page turning of the invention, a present active rod is pushed harder against said first straight segment 50*b* by the additional pushing of the needle of said selecting means which, in turn, is driven by said driving means, the firm stopping by said first straight segment would suddenly yield and cause said first straight segment to move in a way as to pull the apex 50*e* formed by said first straight segment 50*b* and second straight segments 50*c* of said wire form across the width of said guiding means and thus would clear the way for said present active rod to move past the location of said first straight segment of said wire form and to be on its way toward said second limiting stop means, meanwhile, said apex would return quickly by spring action of said wire form to its inoperative location and would suddenly make said first straight segment act effectively as a firm limiting stop again in the face of any rod pushed toward it solely by said pushing means, thereby would provide the updating means for said first limiting stop means.

In the second operative mode found typically in a backward page turning of the invention, when each of said two particular rods comes in contact with said second segment 50*c*, it would pull easily, as they progress, the apex formed by said first and second straight segments of said wire form across the width of said guiding means and thus would clear the way for said particular rods to move past the location of said first straight segment, meanwhile said apex would return quickly to its inoperative location and would suddenly make said first straight segment 50*b* act effectively as a firm limiting stop again in the face of said past active rod, now in the area near said first limiting stop means, when it is pushed solely by said pushing means in the forward direction, thereby would make said past active rod into a present active rod.

In the third operative mode found typically in a setting up operation of the invention, when a group of more than one of said rods are pushed harder against said first straight segment by additional pushing of a hand of the invention's user, said first limiting stop means would allow each rod to behave, when its turn comes, as a present active rod described in said first operative mode.

Finally, in the fourth operative mode found typically in a setting up operation of the invention, when a group of more than two of said particular rods are pushed in the backward direction, said first limiting stop means would allow each rod of this group to behave as one of said two particular rods of said second operative mode, thereby would eventually make the last rod of the group which moves past said first segment a present active rod and would make the invention ready for a page turning operation after a set up or a bulk manual backward turning of several leaves separated by several rods.

Referring to FIG. 3 again, element 60 may be made essentially a mirror image of element 50 with respect to the center of tensioning bar 40. This element 60 acts similarly to element 50 and serves as the second limiting stop means described in the general principles of the invention.

Description/Operation of Pushing Means

Referring to FIG. 3 and to the general principles of the invention, the preferred pushing means comprises:

a. a first pusher 70 preferably of spring steel of about 0.025 in. diameter and of suitable length located near said first limiting stop means, pivoting around one of its ends and having the other end projecting over said continuous slot and having its free tip describing a circular arc above the plane of said tensioning bar and on said convex edge side of said tensioning bar;

b. a second pusher 71 located near said second limiting stop means area:

c. a pulling spring means 72 of suitable strength attached on said two pushers at points 70*a* and 71*a* for pulling the free tips of said pushers toward the center of said tensioning bar;

d. flexible adjusting means 70*b* for limiting the free tip of said first pusher to a critical point located just beyond said first limiting stop means toward the center of said tensioning bar and just beyond the width of said continuous slot on said convex edge side of the said tensioning bar when said free tip is pulled toward the center of said tensioning bar by the sole strength of said pulling spring means; and similar flexible means 71*b* for second pusher 71 in relation to said second limiting stop, for a less extended function as compared to that of 70*b;* e. whereby, in the set up mode, after programmably positioned behind a plurality of leaves to be turned later on, a plurality of rods would have their lower ends guided by said continuous slot of said guiding means and pushed by a user's hand in the forward direction against the free tip of said first pusher, then, by virtue of said flexible adjusting means of said first pusher, its free tip would move beyond said critical point and eventually would clear said continuous slot for each and all said rods to move past said free tip, meanwhile said free tip wouuld return to said critical point thanks to said flexible adjusting means, causing the body of said pusher to lie across said continuous slot, allowing a push, by the user's hand, on said plurality of rods in the backward direction to push along said body at the end of the file of rods; and when all said rods are left alone to be stopped by said first limiting stop means, to cause said body to push the whole file of said rods against said first limiting stop means, until all the rods stopped by said first limiting stop means are exhausted by subsequent page turning operations;

f. whereby said second pusher 71 would begin and continue to push on any rod coming from the forward direction into being stopped by said second limiting stop means against said precise spatially located straight segment of said second limiting stop means, locking one of the last turned pages flat down for reading; and to make ready the rods pushed against said second limiting stop means, for an eventual backward page turning.

Description/Operation of Selecting Means

Figure 5B:
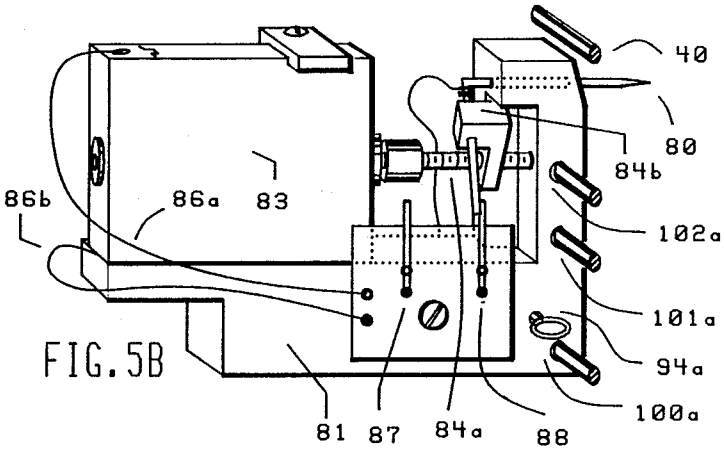
FIG. 5*b* is a side view of the preferred selecting mechanism in the operative position.
Figure 5A:
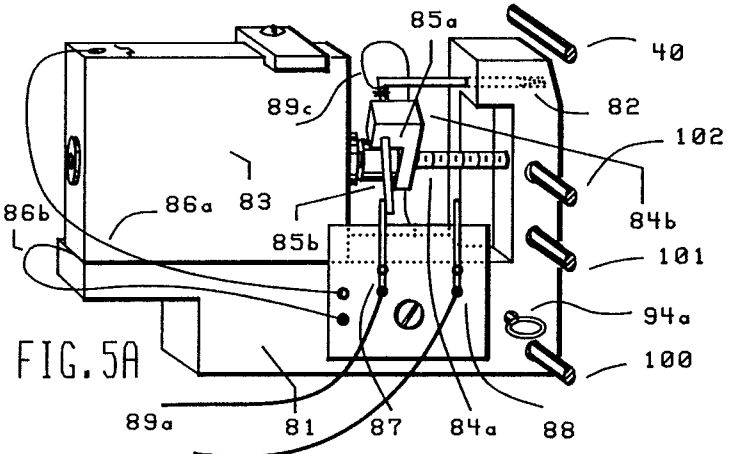
FIG. 5*a* is a side view of the preferred selecting mechanism in the inoperative position.
Figure 4:
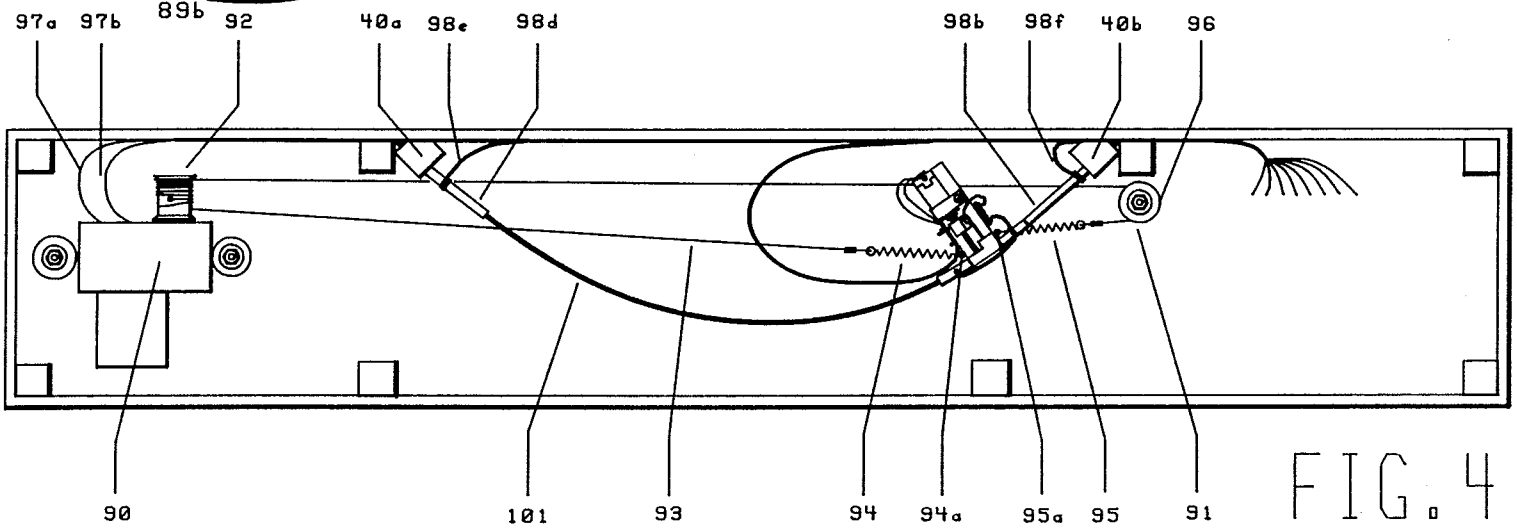
FIG. 4 is a top and partially sectional view of the housing showing more clearly some of the enumerated parts.
Figure 6:
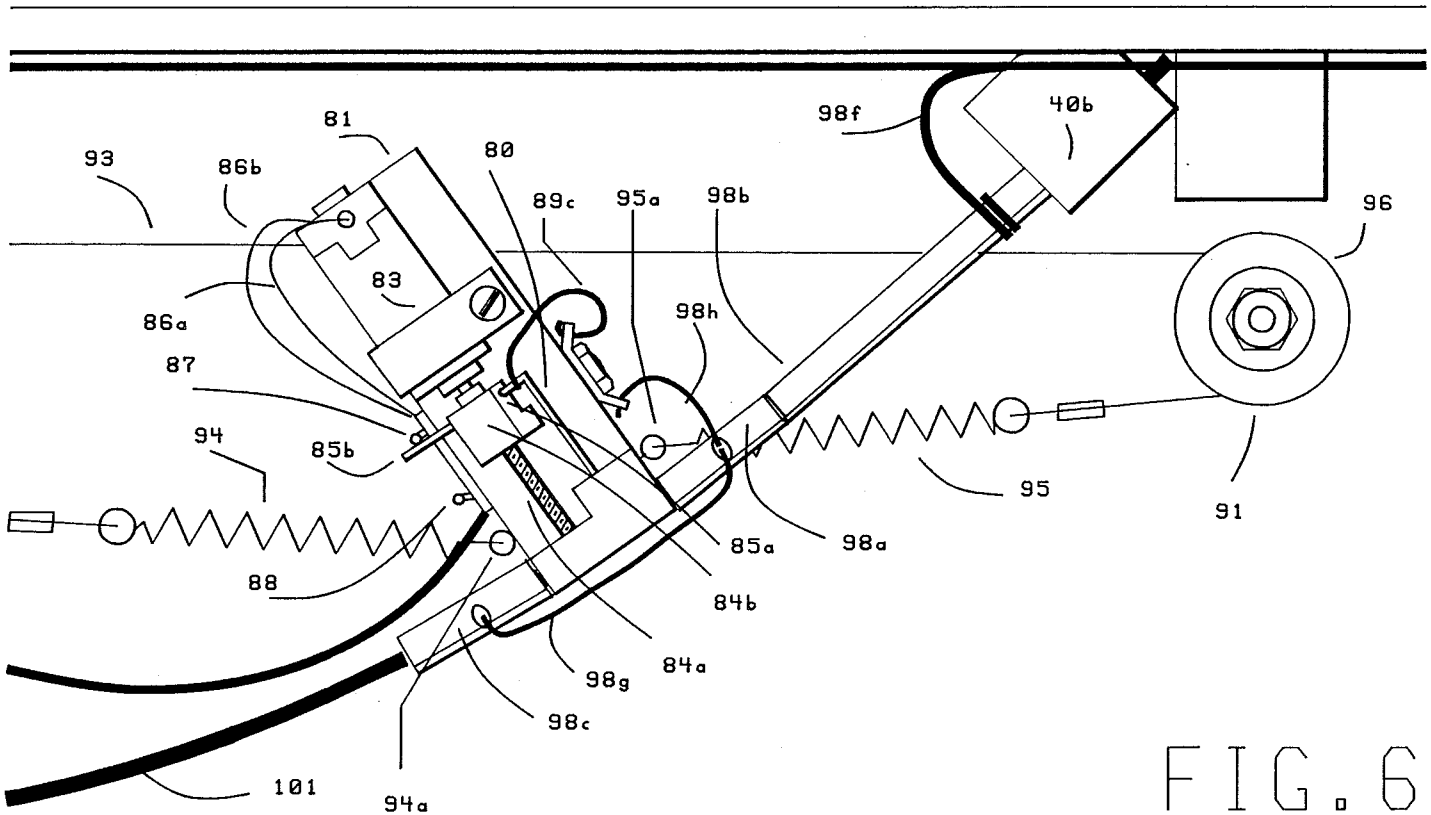
FIG. 6 is a top view of part of the selecting mechanism showing the electrical contacts means.

Referring to FIGS. 4, 5*a* and 5*b* and to the general principles of the invention, the preferred embodiment for a selecting means comprises:

a. a pointed, essentially rectilinear and stiff needle 80 of about 0.031 in. in diameter and of suitable length;

b. selecting block 81 having a bearing 82 therein slides longitudinally said needle in a precise manner such as to move said needle's point end from an inoperative position as in FIG. 5*a* where said needle is retracted, to an operative adjustably fixed position in space as in FIG. 5*b* where said needle is fully extended;

c. said operative adjustably fixed position in space being chosen as located on a line passing by said inoperative position and by an area bounded only critically in one direction by the two longitudinal axes of said present active rod and of the rod next to it.

d. powering means to move, under said control means, said needle's pointed end from said inoperative position to said operative position to cause said pointed end and the body of said needle to overcome the action of said pushing means and to separate said present active rod from the rod next to it and to position the longitudinal body of said needle behind the longitudinal body of said active rod, forming with it an angle approaching a right angle, and to allow said needle to push along positively said active rod when said driving means causes said selecting block to move in said forward direction;

e. tracking means for guiding said selecting block to follow a tracking path essentially parallel to said predetermined path;

f. resetting means to return said needle's pointed end from said operative position to said inoperative position;

g. whereby, in the operation of the invention, said control means would cause said powering means to move said needle's pointed end from said inoperative position to said operative position to select said present active rod and while cooperating with said driving means, to push along positively said present active rod when said driving means causes said selecting block to move in the forward direction and then, after said present active rod has been locked by said second limiting stop means, said resetting means would return said needle's pointed end from said operative position back to said inoperative position before said driving means reverses the direction of said selecting block and relocates said selecting means to said spatially precise stand-by position near said first limiting stop means.

As shown sectionally in FIGS. 4, 5*a*, 5*b*, and 6 the preferred tracking means for the guiding of said selecting block comprises:

a. a plurality of forcingly bent bars 100, 101, and 102 patterned after, and having the same chord, as said tensioning bar 40 and firmly anchored parallel to said tensioning bar 40 preferably by parts 40*a* and 40*b* and having all their two groups of ends confined to two straight lines normal to each plane passing by said convex edge and said chord of each of said forcingly bent bars; these two straight lines are thus also normal to the bottom surface of housing 10.

b. a plurality of bearing means 100*a*, 101*a* and 102*a* on said guiding block therein said plurality of forcingly bent bars 100, 101 and 102 slidably moves;

c. whereby, when said selecting block is driven in the forward direction by a means attached only at a chosen single point 94*a* thereon and in the backward direction by another means attached only at another chosen single point 95*a* thereon, said selecting block can travel in the forward and backward directions only along said forcingly bent bars, therefore, by virtue of parallelism of said bent and tensioning bars involved, the alignment of the needle of said selecting block in relation to a small arc of said tensioning bar in the immediate vicinity of said selecting block would be the same for every position of said selecting block and thus would allow consistently, in the operative position, said needle to impart said driving means in the forward and backward directions to any rod being acted upon.

As seen in FIGS. 4, 5*a* and 5*b*, the powering and resetting means used in the above-described selecting means preferably consist of:

a. an electric motor means 83 attached to said selecting block 81;

b. means for transforming the rotational power of said motor means into a linear translational power in the form of a screw-and-nut assembly 84*a* and 84*b*;

c. means for coupling said needle of said selecting block to said linear translational power in order to move said needle 80 slidably in its bearing 82 on said selecting block, consisting of an aperture 85*a* on the nut 84*b* in which slides freely portion 85*b* bent at right angle from needle 80.

d. electric conductor means 86*a* and 86*b* for powering said motor means;

e. whereby, the rotational power of said motor means, when supplied for a controlled moment, in one direction, would move said needle slidably from said inoperative position to said operative position with a well defined force; in another direction, would move said needle slidably from said operative position to said inoperative position with an equally well defined force; providing thus said powering and resetting means, respectively. In the preferred embodiment of the invention this controlled moment is adapted to be the duration between the time when said needle is in said inoperative position and the time when it is in said operative position, and vice-versa; these two times being conveniently sensed by a uniquely defined electric contact closure generated by portion 85*b* of said needle when it is in said inoperative position where it touches metal wire 87 and another uniquely defined electric contact closure generated by portion 85*b* of said needle when it is in said operative position where it touches metal wire 88 depicted in FIGS. 5*a*, 5*b* and 6 where electric conductor means 89*a*, 89*b* and 89*c* convey the contact closures to the control means.

Description/Operation of Driving, Updating and Returning Means

Referring to FIG. 4 and to the general principles of the invention, the driving and returning means of the invention preferably consist of:

a. an electric motor assembly 90 suitably attached in the neighborhood of one end of said tensioning bar;

b. a free turning pulley means 91 secured in the neighborhood of the other end of said tensioning bar;

c. a driving pulley 92 secured at the end of the output shaft of said motor assembly;

d. a flexible cable means 93 anchored soldily at its middle on said driving pulley; said flexible cable free ends being wrapped a suitable number of turns around the cylindrical body of said driving pulley, each in the opposite direction of the other, and both terminated with two suitably chosen coil springs 94 and 95 which, in turn, are attached to two chosen points 94*a* and 95*a* on the two sides of said selecting block which face the two directions of travel of said selecting block;

e. said flexible cable end attached on the side nearer to said free turning pulley maintaining half a turn 96 on said free turning pulley to cause the pulling of said selecting block toward said free turning pulley when there is a pulling on the cable in the direction from said free turning pulley toward the output shaft of said motor assembly;

f. electric conductor means 97*a* and 97*b* for powering said motor assembly;

g. whereby, the rotational power of the output shaft of said motor assembly, when supplied for a controlled duration, in one direction, would move said selecting block in said forward direction, thereby would provide said driving means; in another direction, would move said selecting block in said backward direction, thereby would provide said returning means. This controlled duration is preferably adapted to be the duration between the time when said selecting block is at the extreme of said predetermined path near said first limiting stop means, where metal tubing 98*a* secured onto selecting block 81 and sliding along forcingly bent bar 101 touches metal tubing 98*b* which is attached onto one extreme of forcingly bent bar 101 through a layer of insulation, and the time when said selecting block is at the other extreme of said predetermined path near said second limiting stop means, where metal tubing 98*c* secured onto selecting block 81 and sliding along forcingly bent bar 101 touches metal tubing 98*d* which is attached, though a layer of of insulation, onto the other extreme of forcingly bent bar 101 and vice-versa. Electric conductor means 98*e*, 98*f*, 98*g* and 98*h* serve to convey the contact closures to the control means.

Description/Operation of Hold-down Means

Figure 7:
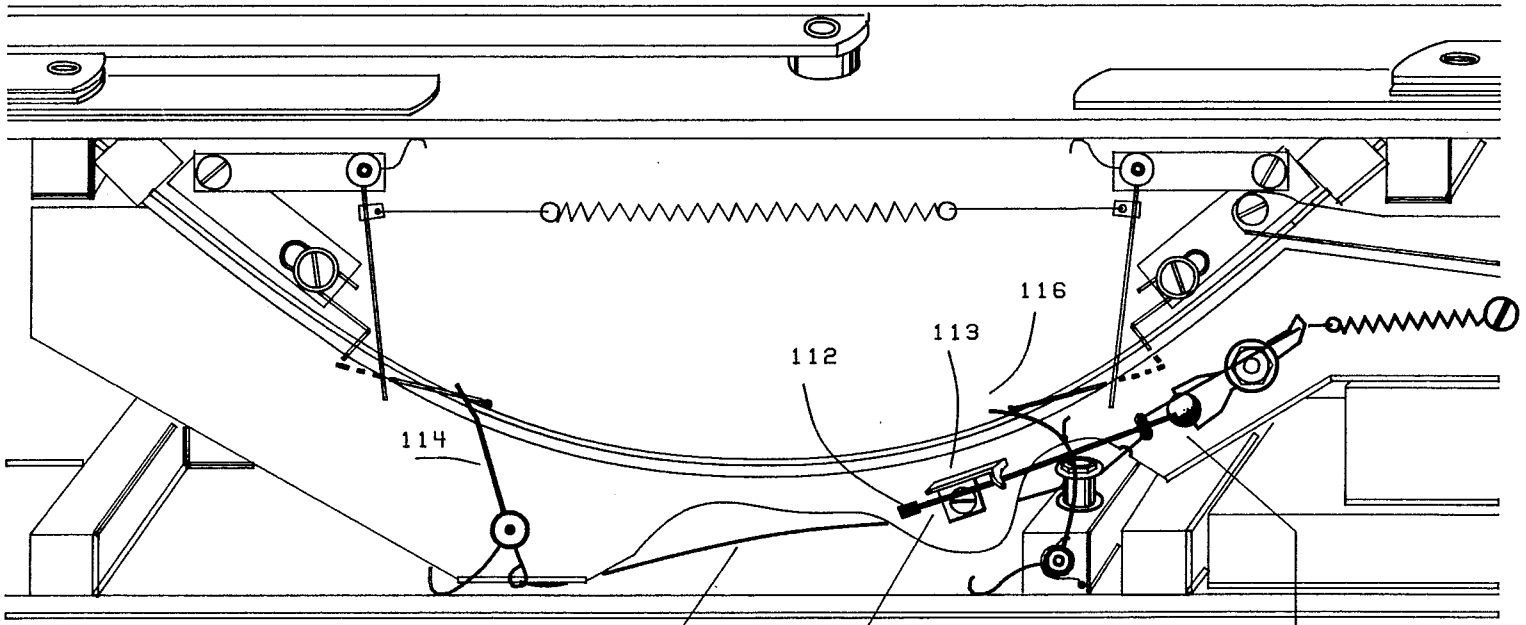
FIG. 7 is a perspective top view of the invention mechanism serving the function of holding down the pages.

To enhance further the reliability of the invention, a page hold-down means as shown in FIG. 7 may be added to the basic invention to flatten out the page which lies nearer to said first limiting stop means just after either the set up time, a forward turning or a backward turning; said hold-down means preferably comprising:

a. a pressure arm 110 swinging around an axis 111 essentially parallel to the plane of said tensioning bar; said pressure arm being spatially located so that in its resting position, its movable tip 112 sets a pressure point against the lower part of the set of leaves of said book located nearer to said first limiting stop means;
b. a latching means 113 to releasably latch said pressure arm in a temporary position away from the lowest edge of any leaf passing over said temporary position;
c. an engaging means 114 located near said second limiting stop means area, to allow any rod moving toward it in the forward direction to slip past it easily, and in the backward direction, to push it along a predetermined distance before slipping past it; said predetermined distance causing said engaging means 114 to pull—preferably by way of cable means 115—said pressure arm 110 toward said latching means 113 and to cause it to be latched thereby;
d. a releasing means 116 located near said first limiting stop means area, allowing any rod moving toward it in the forward direction to slip past it easily and in the backward direction, to push it along a predetermined course before slipping past it; said predetermined course causing said latching means 113 to release said pressure arm 110, allowing it to swing back to said resting position;
e. a security lock means 117,—shown in FIG. 2, located on top of cover 11 of housing 10—, to releasably lock said pressure arm near its temporary position, for portability and for set-up before operation, overriding the action of said releasing means;
f. whereby, during the set up time, said pressure arm would be pushed by the user's hand to be locked in said temporary position by said security lock means while the leaves of said book and said rods are moved about freely by different set up steps, and then, at the end of said set up time, said pressure arm would be manually released to said resting position to hold down the set of leaves located nearer to said first limiting stop means while one of said rods would hold down the set of leaves located nearer to said second limiting stop means, thus securing open the very first set of pages for reading;
g. whereby, during a forward page turning, the leaf in motion would slip gradually under the point of pressure of said pressure arm and would disengage itself from it before the end of the course of said forward page turning, while said pressure point would continue to exert the hold-down effect on the set of leaves underneath said leaf in motion;
h. whereby, during a backward page turning, as soon as said two particular rods are caused to leave said second limiting stop means and travel in the backward direction, they would encounter said engaging means and would pull said pressure arm toward said latching means and would cause it to be latched thereby, then said two particular rods would continue in their course of travel, moving the leaf held between them past said axis of said pressure arm, and then, just before they enter said first limiting stop means, they would cause said releasing means to release said pressure arm for it to swing in a way as to have its pressure tip follow said leaf until said resting position is reached when said two rods would at the same time be locked by said first limiting stop means, thus, while said pressure arm would continue its role of holding down the set of leaves near said first limiting stop means, the backward page turning operation would finish its sequence of steps by executing a complete forward page turning operation returning solely the rod occupying temporarily the position of said present active rod to said second limiting stop means and locking it there to hold down the set of leaves nearer to said second limiting stop means and would make the invention ready again for another backward or forward page turning.

Description/Operation of Control Means

Figure 1:
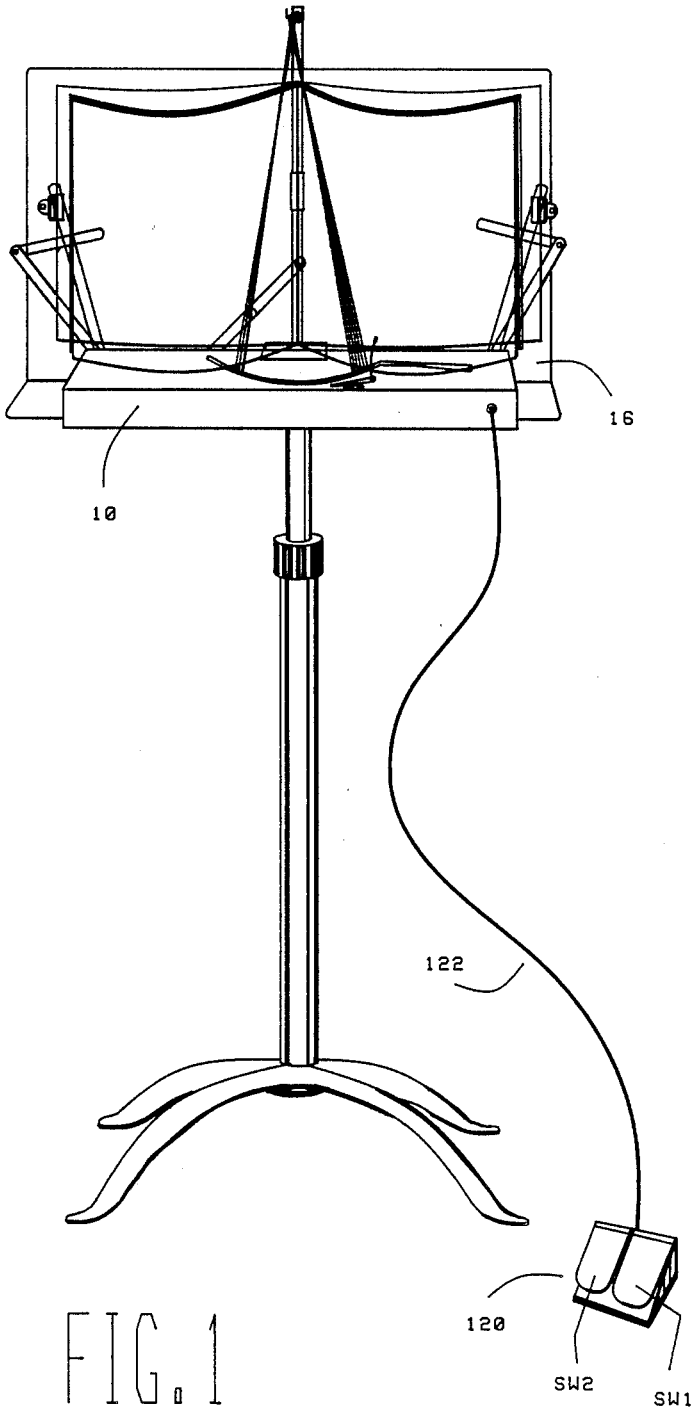
FIG. 1 is a perspective view of a music stand equipped with the page turning device of the present invention in a preferred embodiment, including an example of a preferred electric switch means for a foot of a user to trigger a complete page turning operation with just a simple tap.
Figure 8:
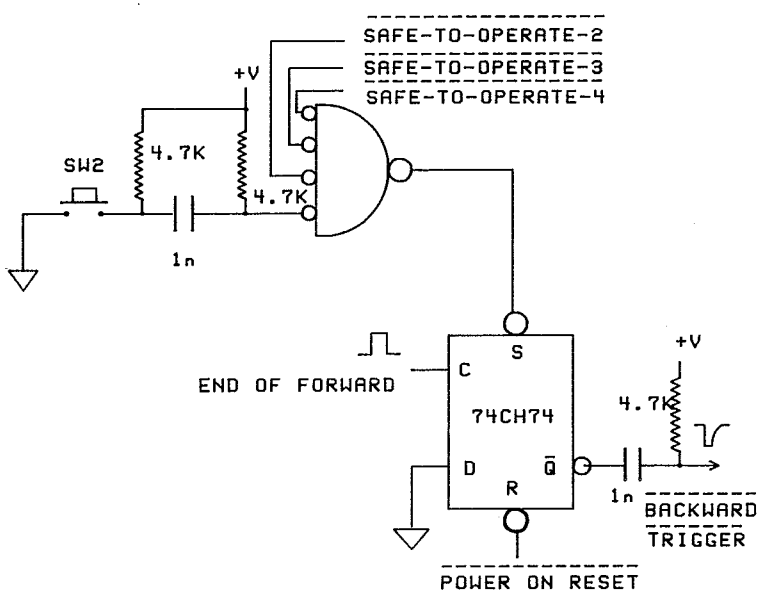
FIG. 8 is an example of a preferred logic circuit means for creating consistently a single cue related to an opration of the page turning, regardless of the variable duration and inconsistent manner in which a foot of the user hits a certain switch.
Figure 8:
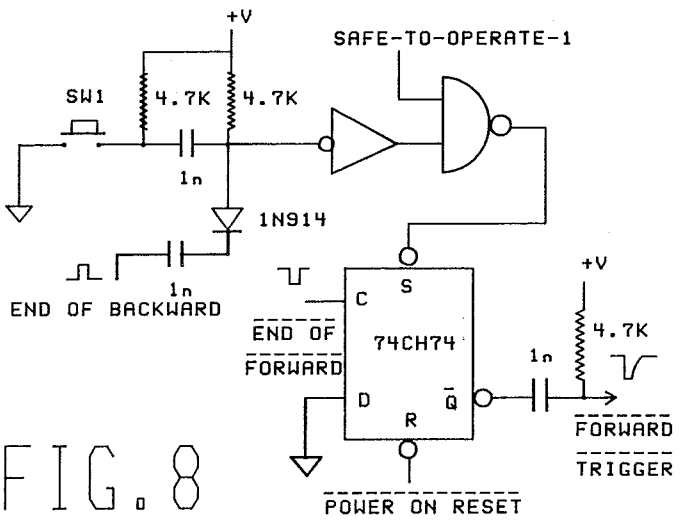

Referring to FIG. 1 and to the general principles of the invention, an electric switch means represents preferably the means to generate the cue for an operation of the invention as applied in music reading, typically either a forward page turning or a backward page turning but not both. This means comprises:

a. an assembly of two distinctly separated sets of electric contacts, one being for forward page turning cue commanded by pedal SW1 and the other being for backward page turning cue commanded by pedal SW2 of foot-switch 120;
b. a switch logic circuit means shown schematically as an example in FIG. 8, for capturing the very first intended change of state of a set of contacts and for latching on as the intended cue for a complete operation of page turning until being reset by a signal produced automatically by the end of the sequence of steps of that particular operation;
c. electric conductor means 122 to link said sets of electric contact to said switch logic circuit means;
d. whereby, when a user of the invention exerts a suitable pressure, typically with a foot or a hand, on one of said sets of electric contacts via one of those pedals, and maintains said pressure for a casually variable duration and in a normally inconsistent manner, said switch logic circuit means would take care consistently of the production of a single intended cue related to that set of contacts.

As an aid to handicapped people, the invention may be optionally fitted with a custom-made command module comprising preferably:

a. transducing means for converting into an electric signal a minimal human action characterized by the successive blinking of an eye, the frowning of an eyebrow, and the producing of a sound with the throat, with many of the well known means of the art (not shown);
b. a switch conditioning circuit (similar to the circuit shown in FIG. 8, in which switches SW1 and SW2 would be typically some relay contacts or the on/off states of an electronic device) for capturing the very first intended happening of said minimal human action and for latching on as the intended cue for a complete operation of page turning until being reset by a signal produced automatically by the end of the sequence of steps of that particular operation;

c. whereby, a severely disabled user of the invention can have said transducing means adapt to one of his best remaining abilities and would be able to command, by himself, at least the forward page turning of a book after it has been set up on the invention with the help of a more able person.

In FIG. 3, compartment 14 is preferably reserved for energizing batteries, and circuit board 15 preferably contains the logic circuit means for taking in cues for the user of the invention and carrying different sequences of steps in actuating said driving, returning, powering and resetting means, and also the interface circuit means for bringing said logic circuit means power level to the power level needed for the motors. These circuits may be implemented easily with any components and techniques of the art and are not described here.

In all the description of page turning operations above, a single leaf is mentioned as being turned. However, it is very easy to appreciate that a reasonable number of leaves may be programmed to be turned, in the forward or the backward direction, by a single rod, and in consequence, by a single cue. This is advantageous, for instance, in the case where one single set up would allow the orderly page turnings of multi-page music pieces, each being separated from the next by a few pages to be skipped through as fast as possible.

From the general principles of operation and from the practical embodiment described above, it can be appreciated that a manual back up mode of operation is always possible in any case of trouble in the normal automatic mode; in most instances, a finger nail can easily select the present active rod, drive it to said second limiting stop means and lock it there, turning a page reliably, albeit by hand; in the worst case where a rod is stuck in traveling in the guiding means, pulling the top-column 28 out of its mating receiver 27*c*, (see FIG. 2), and all the leaves of the book on the page turner of the invention would be free from all the rods, and now the next page can be turned by hand exactly as if no mechanical assistance were involved at any time at all. This is surely a nice security feature for professional use of the invention.

Another nice feature of the top-column 28 being able to be pulled out is that it can be fitted with the right number of rods which are to be pre-programmed behind the leaves to be turned and kept along with the music book until final set up time. The subsequent amount of time required to finish the set up would be substantially reduced.

While the above description contains many specificities, it is to be understood that the present invention is not confined to the particular embodiment set forth herein as illustrative, but embraces such modified forms thereof as come within the scope of the following claims.

What I claim is:

1. A page turning device for a book, comprising:

a. a securing means to adjustably fix a book into an operative position which would allow material to be suitably exposed for reading;

b. a plurality of rods rotatably hanging at their top ends around an adjustably fixed hanger;

c. each of said rods being programmably positioned in sequence behind a group of at least one leaf of said book;

d. guiding means for the lower ends of said rods to travel in a predetermined path;

e. said guiding means allowing the lower end of each of said rods to travel freely between the two extremes of said predetermined path, maintaining said rods in their sequence when they are to travel in groups or when they are lined up to wait for operations;

f. a first limiting stop means located near one of said extremes of said path to provide a firm and spatially precise stopping to the lower end of one of said rods that is made ready to act in the operation of the invention;

g. a second limiting stop means adjustably located near the second of said extremes of said path to provide a firm and spatially precise stopping to the last one of said rods which was made to travel from said first limiting stop means toward said second limiting stop means within the allowance of said guiding means;

h. pushing means to push the group of said rods which crowd near said first limiting stop toward the rod that is firmly and precisely stopped by said first limiting stop, and to push the group of rods which crowd near said second limiting stop toward the rod that is stopped by said second limiting stop means;

i. selecting means to choose a present active rod, defined as the one of said rods that is firmly and precisely stopped by said first limiting stop means, and to isolate said present active rod from the rods that are pushed toward it;

j. driving means to act on said selecting means to cause said present active rod to overcome momentarily said firm and spatially precise stopping by said first limiting stop means and to travel along said guiding means, in the direction from the first stopping means area to the second stopping means area, defined as the forward direction, pushing along with it a group of at least one leaf behind which said present active rod is positioned, and thus causing, by proper design of said predetermined path, the turning of said group of at least one leaf and exposing the next set of pages for reading;

k. updating means to cause the rod positioned next to said present active rod to take the position of the next active rod by causing said first limiting stop means to provide again, after being overcome by said present active rod, immediately said firm and precise stopping to the lower end of said next active rod;

l. said driving means causing said present active rod to overcome said firm stopping by said second limiting stop means and to make said present active rod into said last one of said rods which is made to travel in said forward direction, within the allowance of said guiding means;

m. returning means to relocate said selecting means to a spatially precise stand-by position near said first limiting stop means, completing the process of making said next active rod into a new present active rod;

n. control means to activate on cue the actuation of said selecting means, driving means and returning means;

o. whereby, after a book has been adjustably fixed by said securing means and said plurality of rods has been programmably positioned in sequence each behind each group of at least one leaf of said book and said plurality of rods has been pushed toward the very first present active rod which has been made to be confined by said firm and spatially precise stopping of said first limiting stop means, and the sequentially first set of pages has been exposed for reading, the cue for a forward page turning would start said control means to activate said selecting means to choose said present active rod, then to activate said driving means to act on said selecting means to cause said present active rod to overcome momentarily said firm and spatially precise stopping by said first limiting stop means and to travel along said guiding means, turning a group of at least a leaf of said book and at the end of the course of said present active rod, locking open the next set of pages of said book for reading by virtue of said firm stopping by said second limiting stop means, then to activate said returning means to relocate said selecting means to said spatially precise stand-by location while said pushing means and updating means complete the making of said next active rod into a new present active rod, thus making the invention ready, in a repetitive manner, for the next cue for page turning again, until all the turnings are exhausted.

2. A page turning device for a book as in claim 1 wherein said plurality of rods is composed of a plurality of pieces made of stiff and relatively indeformable material characterized by spring steel, beryllium copper and fiberglass, each being formed essentially as a rectilinear elongated wire of suitable dimensions, terminated at one end thereof with an aperture of suitable dimensions.

3. A page turning device for a book as in claim 2 wherein said rectilinear elongated wire is a rectilinear elongated wire of circular section, and said aperture is formed preferably by a loop of same said wire.

4. A page turning device for a book as in claim 3 wherein said selecting means comprises:

a. a pointed, essentially rectilinear and stiff needle of suitable dimensions;

b. a selecting block having a bearing therein slides longitudinally said needle in a precise manner such as to move said needle's pointed end from an inoperative position to an operative adjustably fixed position in space;

c. said operative adjustably fixed position in space being chosen as located on a line passing by said inoperative position and by an area bounded only critically in one direction by the two longitudinal axes of said present active rod and of the rod next to it;

d. powering means to move, under said control means, said needle's pointed end from said inoperative position to said operative position to cause said pointed end and the body of said needle to overcome the action of said pushing means and to separate said present active rod from the rod next to it and to position the longitudinal body of said needle behind the longitudinal body of said active rod, forming with it an angle approaching a right angle, and to allow said needle to push along positively said active rod when said drivng means causes said selecting block to move in said forward direction;

e. tracking means for guiding said selecting block to follow a tracking path essentially parallel to said predetermined path;

f. resetting means to return said needle's pointed end from said operative position to said inoperative position;

g. whereby, in the operation of the invention, said control means would cause said powering means to move said needle's pointed end from said inoperative position to said operative position to select said present active rod and while cooperating with said driving means, to push along positively said present active rod when said driving means causes said selecting block to move in the forward direction and then, after said present active rod has been locked by said second limiting stop means, said resetting means would return said needle's pointed end from said operative position back to said inoperative position before said driving means reverses the direction of said selecting block and relocates said selecting means to said spatially precise stand-by position near said first limiting stop means.

5. A page turning device for a book as in claim 4 wherein said control means includes means to activate on cue the activation of said driving means to cause said selecting block to travel along said tracking path in the forward direction, wherein, at a precise spatially fixed position with respect to said second limiting stop means, said control means is to actuate said powering means to move said needle's pointed end from said inoperative position to said operative position to cause said needle to overcome the action of said pushing means in separating two particular rods composed of the rod which was formerly a present active rod operated upon by the last forward page turning,—now defined as the last active rod—and the rod next to it,—now defined as the past active rod—,from all the other rods crowding nearby, then to actuate said returning means to relocate said selecting block to said spatially precise stand-by position near said first limiting stop means, causing, in the process, the pushing of said two particular rods in the direction from said second limiting stop means toward said first limiting stop means, defined as the backward direction, overcoming the stopping of said second limiting stop means and then locking said two particular rods by virtue of said first limiting stop means at the end of the course of the selecting block; whereby, after said book has been adjustably fixed by said securing means, a first rod has been programmed to be locked by the stopping of said second limiting stop means, said plurality of rods has been programmably positioned in sequence each behind each group of at least one leaf of said book, said plurality of rods has been pushed toward said very first present active rod which has been made to be confined by said firm and spatially precise stopping of said first limiting stop means, exposing in the process the sequentially very first set of pages of said book for reading, and after at least one forward page turning has been performed on the invention, the cue for a backward page turning would start said control means to activate said driving means to act on said selecting block to travel along said tracking path in said forward direction; and, at a precise spatially fixed position with respect to said second limiting stop means, to activate said powering means to move said meedle's pointed end from said inoperative to said operative position to cause the pointed end and the body of said needle to overcome the action of said pushing means in separating said two particular rods from all other rods crowding nearby; and to actuate said returning means to relocate said selecting block to said spatially precise stand-by position near said first limiting stop means, causing in the process the pushing of said two particular rods in said backward direction along said predetermined path, thus causing the group of at least one leaf confined between said two particular rods to turn in a way as to expose the last set of pages for reading, and to lock said two particular rods by virtue of said first limiting stop means; to actuate said resetting means to return said needle's pointed end from said operational position back to said inoperative position while said pushing means and updating means complete the making of said past active rod—now in the area near said first limiting stop means—into a temporary present active rod; then finally to issue automatically a cue for a complete forward page turning to bring said temporary present active rod to the area near said second limiting stop means and to lock it there by virtue of said second limiting means as a new last active rod; thus making the invention ready, in a repeated manner, for the next cue for backward, or forward page turning until all the turnings are exhausted.

6. A page turning device for a book as in claim 5 wherein said guiding means comprises:

a. a tensioning bar preferably of spring steel of proper diameter and of a chosen precise length, forcingly bent into an arc whose chord is precisely chosen, by allowing each end of said arc to push freely against a spatially fixed shallow well of diameter just a little bit greater than the diameter of said tensioning bar, and by firmly anchoring portion of said rod near its two ends in a chosen plane passing by said arc, making that arc to take on a self-aligning shape uniquely determined mathematically and physically by only the length of said tensioning bar and the length of said chord, the uniformity in diameter of said tensioning bar being assured in real practice;

b. a main rail made of hard material, preferably hard plastic, having a concave contour of essentially uniform thickness and parallel to the convex edge of said arc of the tensioning bar on most of the length thereof and adjustably secured spatially so that said convex edge forms with said concave contour a continuous slot the width thereof being a chosen width adjustably made to be a little bit greater than the diameter of said plurality of rods;

c. a secondary rail of preferably the same said hard plastic forming with the remaining part of said main rail a slot going gradually from a receiving width considerably greater than said chosen width to a width of the same size as said chosen width when it merges into said continuous slot;

d. whereby each of said plurality of rods, after hanging at its top end on said hanger, can have its lower end enter easily said continuous slot by way of said receiving width, thus making said continuous slot into a predetermined-path guiding means for the low end of said plurality of said rods.

7. A page turning device for a book as in claim 6 wherein said tensioning bar is a straight line throughout its length.

8. A page turning device for a book as in claim 6 wherein said first limiting stop means is a wire form preferably made of a shape-memorizing material characterized by spring steel and beryllium copper having:

a. at one end thereof a U-shaped open loop adapted to be adjustably secured in a spatially fixed location by suitable means;

b. at the center thereof a first straight segment of suitable length which is the continuation of one branch of said U-shaped open loop and which forms a right angle therewith, said straight segment being itself oriented by said spatially fixed location of said first limiting stop means to be essentially orthogonal to the tangent of said convex edge at the point where said first straight segment crosses said convex edge in the inoperative mode of said first limiting stop means;

c. at the other end thereof, the continuation into a second segment of said first straight segment, forming therewith an angle between 45 and 75 degrees;

d. and at the free end of said second segment, a continuation into a third relatively short segment forming part of a line essentially normal to the plane passing by all the lines of said spring-steel wire form described heretofore, and bearing against one point of the concave edge of said tensioning bar in the said inoperative mode, said third relatively short segment providing additional means for adjusting suitably the firmness and the precision of said spatially fixed location of said first limiting stop means;

f. whereby, in the inoperative mode of said first limiting stop means said pushing means, endowed with suitable strength, would push said presently active rod toward said first straight segment in the forward direction, and would cause only said present active rod to bear against said first straight segment and to be stopped firmly thereby at a spatial location precise in relation to said needle's pointed end of said selecting means, thereby would provide the limiting stopping action for said first limiting stop means;

g. whereby, in the first operative mode found typically in a forward page turning of the invention, a present active rod is pushed harder against said first straight segment by the additional pushing of the needle of said selecting means which, in turn, is driven by said driving means, the firm stopping by said first straight segment would suddenly yield and cause said first straight segment to move in a way as to pull the apex formed by said first and second straight segments of said wire form across the width of said guiding means and thus would clear the way for said present active rod to move past the location of said first straight segment of said wire form and to be on its way toward said second limiting stop means, meanwhile, said apex would return quickly by spring action of said wire form to its inoperative location and would suddenly make said first straight segment act effectively as a firm limiting stop again in the face of any rod pushed toward it solely by said pushing means, thereby would provide the updating means for said first limiting stop means;

h. whereby, in the second operative mode found typically in a backward page turning of the invention, when each of said two particular rods comes in contact with said second segment, it would pull easily as they progress, the apex formed by said first and second straight segments of said wire form across the width of said guiding means and thus would clear the way for said particular rods to move past the location of said first straight segment, meanwhile said apex would return quickly to its inoperative location and would suddenly make said first straight segment act effectively as a firm limiting stop again in the face of said past active rods when it is pushed solely by said pushing means in the forward direction, thereby would make said past active rod into a present active rod.

i. whereby, in the third operative mode found typically in a setting up operation of the invention, when a group of more than one of said rods are pushed harder against said first straight segment by additional pushing of a hand of the invention's user, said first limiting stop means would allow each rod to behave, when its turn comes, as a present active rod in said first operative mode;

j. whereby, in the fourth operative mode found typically in a setting up operation of the invention, when a group of more than two of said particular rods are pushed in the backward direction, said first limiting stop means would allow each rod of this group to behave as one of said two particular rods of said second operative mode, thereby would eventually make the last rod of the group which moves past said first segment a present active rod and would make the invention ready for a page turning operation after a set up or a bulk manual backward turning of several leaves separated by several rods.

9. A page turning device for a book as in claim 8 wherein said second limiting stop means is a wire form having the mirror image of said first limiting stop means.

10. A page turning device for a book as in claim 9 wherein said tracking means for guiding said selecting block commprises:

a. a plurality of forcingly bent bars patterned after and having the same chord as said tensioning bar and firmly anchored paarallel to said tensioning bar and having all their two groups of ends confined to two straight lines normal to each plane passing by said convex edge and said chord of each of said forcingly bent bars;

b. a plurality of bearing means on said guiding block therein said plurality of forcingly bent bars slidably moves;

c. whereby, when said selecting block is driven in the forward direction by a means attached only at a chosen single point thereon and in the backward direction by another means attached only at another chosen single point thereon, said selecting block can travel in the forward and backward directions only along said forcingly bent bars, therefore, by virtue of parallelism of said bent and tensioning bars involved, the alignment of the needle of said selecting block in relation to a small arc of said tensioning bar in the immediate vicinity of said selecting block would be the same for every position of said selecting block and thus would allow, in the operative position, said needle to impart said driving means in the forward and backward directions to any rod being acted upon.

11. A page turning device for a book as in claim 10 wherein said powering and resetting means consist of:

a. an electric motor means attached to said selecting block;

b. means for transforming the rotational power of said motor into a linear translational power;

c. means for coupling said needle of said selecting block to said linear translational power in order to move said needle slidably in its bearing on said selecting block;

d. electric conductor means for powering said motor means;

e. whereby, the rotational power of said motor means, when supplied for a controlled moment, in one direction, would move said needle slidably from said inoperative position to said operative position with a well defined force; in another direction, would move said needle slidably from said operative position to said inoperative position with an equally well defined force; providing thus said powering and resetting means, respectively.

12. A page turning device for a book as in claim 11 wherein said controlled moment is adapted to be the duration between the time when said needle is in said inoperative position and the time when it is in said operative position, and vice-versa; these two times being conveniently sensed by a uniquely defined electric contact closure generated by said needle when it is in said inoperative position and another uniquely defined electric contact closure generated by said needle when it is in said operative position.

13. A page turning device for a book as in claim 12 wherein said driving and returning means consist of:

a. an electric motor assembly suitably attached in the neighborhood of one end of said tensioning bar;

b. a free turning pulley means secured in the neighborhood of the other end of said tensioning bar;

c. a driving pulley secured at the end of the output shaft of said motor assembly;

d. a flexible cable means anchored solidly at its middle on said driving pulley; said flexible cable free ends being wrapped a suitable number of turns around the cylindrical body of said driving pulley, each in the opposite direction of the other, and both terminated with two suitably chosen coil springs which, in turn, are attached to two chosen points on the two sides of said selecting block which face the two directions of travel of said selecting block;

e. said flexible cable end attached on the side nearer to said free turning pulley maintaining half a turn on said free turning pulley to cause the pulling of said selecting block toward said free turning pulley when there is a pulling on the cable in the direction from said free turning pulley toward the output shaft of said motor assembly;

f. electric conductor means for powering said motor assembly;

g. whereby, the rotational power of the output shaft of said motor assembly, when supplied for a controlled duration, in one direction, would move said selecting block in said forward direction, thereby would provide said driving means; in another direction, would move said selecting block in said backward direction, thereby would provide said returning means.

14. A page turning device for a book as in claim 13 wherein said controlled duration is adapted to be the duration between the time when said selecting block is at the extreme of said predetermined path near said first limiting stop means, and the time when said selecting block is at the other extreme of said predetermined path near said second limiting stop means, and vice-versa; these two times being conveniently sensed by a uniquely defined electric contact closure generated by said selecting block at one extreme of said predetermined path and another uniquely defined electric contact closure generated by said selecting block at the other extreme of said predetermined path.

15. A page turning device for a book as in claim 14 wherein said control means comprises:

a. logic circuit means for taking in cues from the user of the invention and carrying different sequences of steps in actuating said driving, returning, powering and resetting means;

b. electric switch means for transducing a generally imprecise movement of the user of the invention into a precise electric cue to cause said logic circuit means to issue a sequence of steps for a forward or backward page turning;

c. interface circuit means for bringing said logic circuit means power level to the power level needed for said motor means and motor assembly;

d. electric energizing means for powering said logic circuit means, said interface circuit means and said motor assembly and motor means when needed.

16. A page turning device for a book as in claim 15 wherein said pushing means comprises:

a. a first pusher preferably of spring steel of suitable diameter and length located near said first limiting stop means, pivoting around one of its ends and having the other end projecting over said continuous slot and having it free tip describing an arc above the plane of said tensioning bar and on said convex edge side of said tensioning bar;

b. a second pusher located near said second limiting stop means area;

c. a pulling spring means of suitable strength attached on said two pushers for pulling the free tips of said pushers toward the center of said tensioning bar;

d. flexible adjusting means for limiting the free tip of said first pusher to a critical point located just beyond said first limiting stop means toward the center of said tensioning bar and just beyond the width of said continuous slot on said convex edge side of the said tensioning bar when said free tip is pulled toward the center of said tensioning bar by the sole strength of said pulling spring means;

e. wherein, in the set up mode, after programmably positioned behind a plurality of leaves to be turned later on, a plurality of rods would have their lower ends guided by said continuous slot of said guiding means and pushed by a user's hand in the forward direction against the free tip of said first pusher, then, by virtue of said flexible adjusting means of said first pusher, its free tip would move beyond said critical point and eventually would clear said continuous slot for each and all said rods to move past said free tip, meanwhile said free tip would return to said critical point thanks to said flexible adjusting means, causing the body of said pusher to lie across said continuous slot, allowing a push, by the user's hand, on said plurality of rods in the backward direction to push along said body at the end of the file of rods; and when all said rods are left alone to be stopped by said first limiting stop means, to cause said body to push the whole file of said rods against said first limiting stop means, until all the rods stopped by said first limiting stop means are exhausted by subsequent page turning operations;

f. whereby said second pusher would begin and continue to push on any rod coming from the forward direction into being stopped by said second limiting stop means against the precise spatially located straight segment of said second limiting stop means, locking the very last one of the last turned pages flat down for reading; and to make ready the rods pushed against said second limiting stop means for an eventual backward page turning.

17. A page turning device for a book as in claim 16 wherein a page hold-down means is added to flatten out the page which lies nearer to said first limiting stop means just after the set up time, after a forward turning or after a backward turning; said hold-down means comprising:

a. a pressure arm swinging around an axis essentially parallel to the plane of said tensioning bar; said pressure arm being spatially located so that in its resting position, its movable tip sets a pressure point against the lower part of the set of leaves of said book located nearer to said first limiting stop means;

b. a latching means to releasably latch said pressure arm in a temporary position away from the lowest edge of any leaf passing over said temporary position;

c. an engaging means located near said second limiting stop means area, allowing any rod moving toward it in the forward direction to slip past it easily, and in the backward direction, to push it along a predetermined distance before slipping past it; said predetermined distance causing said engaging means to pull—preferably by way of cable means—said pressure arm toward said latching means and to cause it to be latched thereby;

d. a releasing means located near said first limiting stop means area, allowing any rod moving toward it in the forward direction to slip past it easily and in the backward direction, to push it along a predetermined course before slipping past it; said predetermined course causing said latching means to release said pressure arm, allowing it to swing back to said resting position;

e. a security lock means to releasably lock said pressure arm near its temporary position, overriding the action of said releasing means;

f. whereby, during the set up time, said pressure arm would be pushed by the user's hand to be locked in said temporary position by said security lock means while the leaves of said book and said rods are moved about freely by different set up steps, and then, at the end of said set up time, said pressure arm would be manually released to said resting position to hold down the set of leaves located nearer to said first limiting stop means while one of said rods would hold down the set of leaves located nearer to said second limiting stop means, thus securing open the very first set of pages for reading;

g. whereby, during a forward page turning, the leaves in motion would slip gradually under the point of pressure of said pressure arm and would disengage themselves from it before the end of the course of said forward page turning, while said pressure point would continue to exert the hold-down effect on the set of leaves underneath said leaves in motion;

h. whereby, during a backward page turning, as soon as said two particular rods are caused to leave said second limiting stop means and travel in the backward direction, they would encounter said engaging means and would pull said pressure arm toward said latching means and would cause it to be latched thereby, then said two particular rods would continue in their course of travel, moving the group of leaves held between them past said axis of said pressure arm, and then, just before they enter said first limiting stop means, they would cause said releasing means to release said pressure arm for it to swing in a way as to have its pressure tip follow said group of leaves until said resting position is reached when said two rods would at the same time be locked by said first limiting stop means, thus, while said pressure arm would continue its role of holding down the set of leaves near said first limiting stop means, the backward page turning operation would finish its sequence of steps by executing a complete forward page turning operation returning solely the rod occupying temporarily the position of said present active rod to said second limiting stop means and locking it there to hold down the set of leaves nearer to said second limiting stop means and would make the invention ready again for another backward or forward page turning.

18. A page turning device for a book as in claim 17 wherein the majority of the means of the invention are spatially positioned in relation to each others around and inside an essentially rectangular closed box of a size suitable to be carried in a normal attache case when not in use, and when in use, to be inconspicuously blending with the music desk of a music stand commonly found at home, in an orchestra and on a keyboard instrument characterized by a piano, an organ, a hapsicord and an electronic synthesizer.

19. A page turning device for a book as in claim 18 wherein said electric switch means comprises:

a. an assembly of two distinctly separated sets of electric contacts, one being for forward page turning cue and the other being for backward page turning cue;

b. a switch logic cirucit means for capturing the very first intended change of state of a set of contacts and for latching on as the intended cue for a complete operation of page turning until being reset by a signal produced automatically by the end of the sequence of steps of that particular operation;

c. whereby, when a user of the invention exerts a suitable pressure, typically with a foot or a hand, on one of said sets of electric contacts and maintains said pressure for a casually variable duration and in a normally inconsistent manner, said switch logic circuit means would take care consistently of the production of a single intended cue related to that set of contacts.

20. A page turning device for a book as in claim 18 wherein said electric switch means comprises:

a. transducing means for converting into an electric signal a minimal human action characterized by the successive blinking of an eye, the frowning of an eyebrow, and the producing of a sound with the throat;

b. a switch conditioning circuit for capturing the very first intended happening of said minimal human action and for latching on as the intended cue for a complete operation of page turning until being reset by a signal produced automatically by the end of the sequence of steps of that particular operation;

c. whereby, a severely disabled user of the invention can have said transducing means adapt to one of his best remaining abilities and would be able to command, by himself, at least the forward page turning of a book after it has been set up on the invention with the help of a more able person.

* * * * *